United States Patent [19]

Muraji

[11] Patent Number: 4,984,547

[45] Date of Patent: Jan. 15, 1991

[54] FUEL INJECTION SYSTEM FOR INJECTION CARBURETORS

[75] Inventor: Tetsuo Muraji, Odawara, Japan

[73] Assignee: Mikuni Kogyo Kabushiki Kaisha, Tokyo, Japan

[21] Appl. No.: 341,827

[22] Filed: Apr. 24, 1989

[30] Foreign Application Priority Data

Nov. 5, 1987 [JP] Japan ..... 62-169266

[51] Int. Cl.[5] ..... F02M 41/00

[52] U.S. Cl. ..... 123/463; 123/462

[58] Field of Search ..... 123/463, 462, 465, 452–455, 123/457, 460, 445

[56] References Cited

U.S. PATENT DOCUMENTS

| | | | |
|---|---|---|---|
| Re. 25,672 | 10/1964 | Armstrong | 123/463 |
| 1,955,037 | 4/1934 | Viel | 123/463 |
| 2,926,646 | 3/1960 | Prentiss | 123/463 |
| 2,957,467 | 10/1960 | Ball | 123/463 |
| 3,311,099 | 3/1967 | Beaber | 123/463 |
| 3,409,276 | 11/1968 | Fuchs | 123/463 |
| 4,228,977 | 10/1980 | Haase | 123/463 |

*Primary Examiner*—Carl S. Miller

*Attorney, Agent, or Firm*—Lalos & Keegan

[57] ABSTRACT

The fuel injection system for injection carburetors is provided with an air section of regulator and a fuel section of regulator which are arranged opposedly to each other on both the sides of a suction tube, and a connecting member equipped with a fuel injection valve for controlling fuel injection from the fuel section of regulator into the suction tube. The air section of regulator comprises a depression chamber and an air chamber which are separated from each other by a diaphragm, whereas the fuel section of regulator comprises a fuel chamber and a fuel injection chamber which are separated from each other by another diaphragm and communicated with each other through an orifice. The depression chamber is so adapted as to receive negative pressure from a venturi in the suction tube. The connecting member is connected between said two diaphragms and is urged so as to close the fuel injection port with the fuel injection valve. This fuel injection system is simple in the structure thereof, manufacturable at a low cost, has high responsibility in variation of fuel injection rate relative to variation of flow rate of air to be sucked and assures high metering accuracy of fuel to be injected.

6 Claims, 2 Drawing Sheets

FUEL INJECTION SYSTEM FOR INJECTION CARBURETORS

BACKGROUND OF THE INVENTION

1. Field of the Invention:

The present invention relates to a fuel injection system for injection carburetors which adjusts fuel injection rate adequately on the basis of negative pressure produced dependently on air flow rate.

2. Description of the Prior Art:

The fuel injection system of this type has already been disclosed, for example, by Japanese Preliminary Patent Publication No. Sho 63-5150. This conventional fuel injection system is adapted to control flow rate of fuel to be injected into a suction tube through a fuel jet from a fuel chamber so as to balance fuel pressure downstream the fuel jet communicated with the fuel chamber with negative pressure produced in the venturi by arranging a regulator consisting of a depression chamber and a fuel pressure chamber which are divided by a diaphragm, and by introducing negative pressure from the venturi arranged in the suction tube into the depression chamber of the regulator.

This conventional fuel injection system comprises a long fuel passage from the fuel pressure chamber to the fuel nozzle, thereby posing problems that ignorable time lags are produced between variation of flow rate of the air flowing through the suction tube and variation of flow rate of the fuel injected through the fuel nozzle, and that the fuel injection system itself has a complicated structure.

SUMMARY OF THE INVENTION

In view of the problems described above, it is a primary object of the present invention to provide a fuel injection system for injection carburetors having a relatively simple structure and high responsibility of variation of fuel injection rate relative to variation of flow rate of air to be sucked.

It is another object of the present invention to provide a fuel injection system for injection carburetors having high metering accuracy for fuel injection rate and manufacturable at a low cost.

According to the present invention, these objects are attained by equipping a fuel injection system with an air section of regulator which is divided by a first diaphragm into a depression chamber for receiving negative pressure from the venturi arranged in the suction tube and an air chamber kept at atmospheric pressure, a fuel section of regulator which is divided by a second diaphragm into a fuel chamber for introducing fuel from a fuel supply source and a fuel injection chamber which is communicated with the fuel chamber through an orifice and has an fuel injection port for injecting the fuel into the suction tube, and a connecting member which is connected to the first and second diaphragms and has an injection valve capable of opening and closing said fuel injection port.

In a preferred formation of the present invention, the air section of regulator and the fuel section of regulator are equipped with a first and second resilient means for urging the connecting member in the opposite directions respectively, resilience of the first resilient means being set at a level a little higher than that of the second resilient means so that the fuel injection port is closed by the fuel injection valve while the engine is rested.

Resilience of the first resilient means is adjustable with a suitable adjusting means.

According to the present invention, the first diaphragm is displaced by negative pressure produced depending on flow rate of air passing through the venturi arranged in the suction tube, the fuel injection valve is shifted from the closed position by movement of the connecting member to allow the fuel to be injected through the fuel injection port in an amount corresponding to the air flow rate and the fuel flows from the fuel chamber through the orifice into the fuel injection chamber, whereby fuel pressure is kept constant in the fuel injection chamber and the fuel injection valve is maintained at said shifted position.

In another formation of the present invention, the air section of regulator and the fuel section of regulator are arranged opposedly to the manifold wall downstream the throttle valve so as to compose a fuel injection unit. This fuel injection unit may be arranged for each of cylinders.

These and other objects as well as the features and advantages of the present invention will become apparent from the following detailed description of the preferred embodiments when taken in conjunction with the accompanying drawings.

DESCRIPTION OF THE PREFERRED EMBODIMENTS

Figure 1:
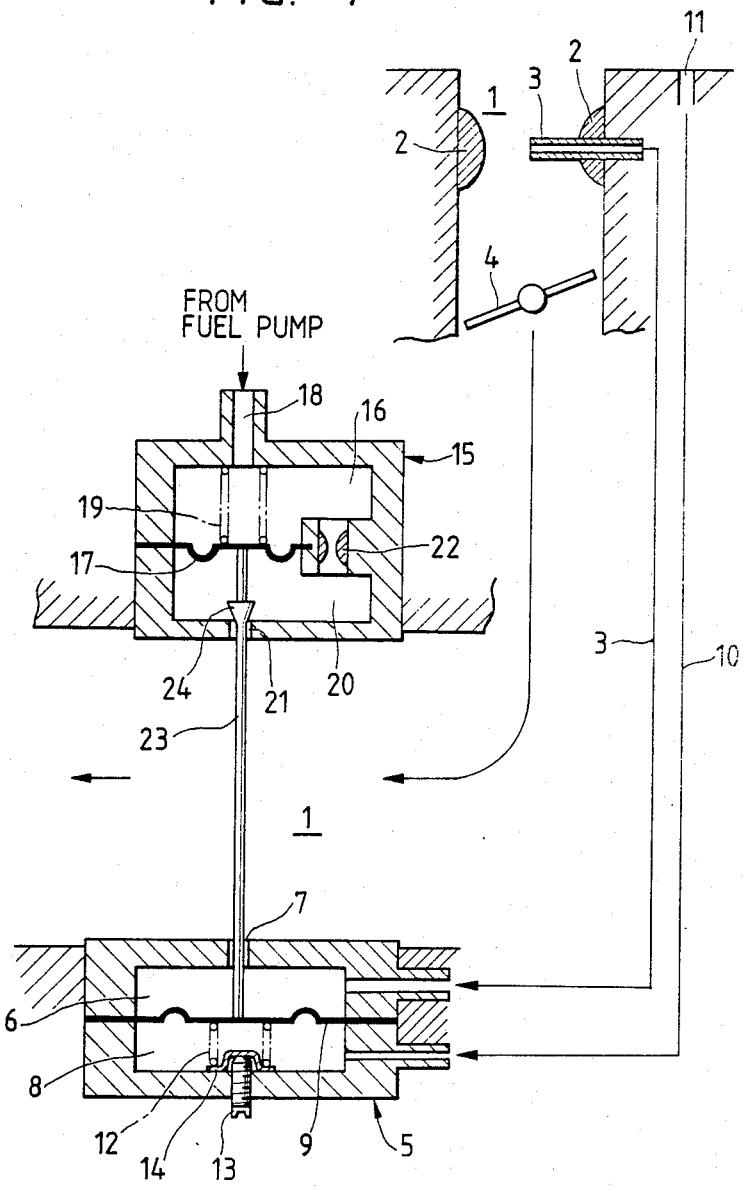
FIG. 1 is a schematic sectional view illustrating Embodiment 1 of the fuel injection system for injection carburetors according to the present invention.

Now, the Embodiment 1 of the present invention will be described below with reference to FIG. 1. In this drawing, the reference numeral 1 represents a suction tube, the reference numeral 2 designates a venturi arranged in the suction tube 1, the reference numeral 3 denotes a negative pressure passage having an opening in the venturi 2, the reference numeral 4 represents a throttle valve which is arranged downstream the venturi 2 in the suction tube 1 and opened and closed by an accelerator pedal, and the reference numeral 5 designates an air section of regulator which is arranged in the inside wall of the suction tube 1 downstream the throttle valve 4 in the suction tube 1. The reference numeral 6 represents a depression chamber which is enclosed by the housing of the air section of regulator and a first diaphragm 9 but communicated with the negative pressure passage 3, and into which negative pressure produced in the venturi 2 is to be introduced, and the reference numeral 7 designates an opening which is formed in the side wall of the depression chamber 6 facing the suction tube 1 and has a diameter a little larger than that of the connecting member to be deScribed later. Since the opening 7 is substantially sealed by the connecting member, internal pressure of the depression chamber 6 is not influenced by the internal pressure of the depression chamber 6. The reference numeral 8 represents an air chamber arranged on the side opposite to the depression chamber 6 with regard to the first diaphragm 9, the reference numeral 10 designates an air passage for introducing the air pressure upstream the venturi 2 in the suction tube 1 into the air chamber 8 through an air vent 11, the reference numeral 12 denotes a spring provided in the air chamber 8 to urge the first diaphragm 9 toward the depression chamber 6 and the reference numeral 13 represents an adjusting screw which is screwed in the side wall of the air chamber 8 for allowing to adjust initial resilience of the spring 12 by way of a support plate 14. The reference numeral 15 represents a fuel section of regulator which is arranged in the inside wall of the suction tube 1 on the side opposite to the air section of regulator 5 with regard to the suction tube 1. The reference numeral 16 represents a fuel chamber which is enclosed by the housing of the fuel section of regulator 15 and a second diaphragm 17 and has a fuel entrance 18 through which a fuel is to be supplied by a fuel pump (not shown), the reference numeral 19 designates a spring provided in the fuel chamber 16 to ruge the second diaphragm 17 toward the suction tube 1, the reference numeral 20 denotes a fuel injection chamber arranged on the side opposite to the fuel chamber 16 with regard to the second diaphragm 16, and the reference numeral 21 represents a fuel injection port having an opening in the side wall of the fuel injection chamber 20 facing the suction tube 1. The reference numeral 22 represents an orifice which communicates the fuel chamber 16 with the fuel injection chamber 20 and is adapted to allow the fuel to flow from the fuel chamber 16 when the fuel is injected through the fuel injection port 21 and fuel pressure becomes low in the fuel injection chamber 20. The reference numeral 23 represents a connecting member which is inserted commonly in the opening 7 of the depression chamber 6 and the fuel injection port 21 of the fuel injection chamber 20, and has ends connected to the first diaphragm 9 in the air section of regulator 5 and the second diaphragm 17 in the fuel section of regulator 15 respectively, and the reference numeral 24 designates a tapered needle valve or a fuel injection valve formed on the connecting member 23 so a to permit opening and closing the fuel injection port 21. Resilience of the spring 19 is set at a level a little higher than that of the spring 12 so that the fuel injection port 21 is closed by the needle valve 24 while the pressure in the depression chamber 6 is equal to that in the air chamber 8 but, once negative pressure is introduced into the depression chamber 8, the needle valve 24 is displaced to open the fuel injection port 21 to a degree in accordance with the level of the negative pressure, thereby controlling consumption rate of the fuel injected through the fuel injection port 21.

Now, function of the Embodiment 1 will be described below. In the condition where negative pressure is not produced in the venturi 2 before the engine is started, the fuel is not discharged into the suction tube 1 since the pressure in the depression chamber 6 is equal to that in the air chamber 8 and the fuel injection port 21 is closed by the needle valve 24. When air is flowed in the suction tube 1 and negative pressure is produced in the venturi 2 by starting the engine, a difference is produced between the pressure in the depression chamber 6 and that in the air chamber 8 of the air section of regulator 5, and the first diaphragm 9 is displaced toward the depression chamber 6, thereby pushing the connecting member 19 toward the fuel section of regulator 15. Since the needle valve 24 is made apart from the fuel injection port 21 in this condition, the fuel is injected into the suction tube 1 through the gap formed between the needle valve 24 and the fuel injection port 21. Accordingly, fuel pressure becomes lower in the fuel injection chamber 20 and the needle valve 24 is urged in the closing direction but, on the other hand, the fuel is supplied into the fuel injection chamber 20 from the fuel chamber 16 through the orifice 22, whereby fuel pressure in the fuel injection chamber 20 is raised to the initial level thereof. As a result, pressure in the fuel injection chamber 20 is kept substantially at a constant level even during the fuel injection, and the pushing forces acting on the connecting member 23 are balanced between the direction toward the fuel section of regulator 15 and that toward the air section of regulator 5 so long as the negative pressure is not varied in the depression chamber 6, thereby maintaining the needle valve 24 at that position. Then, when the flow rate of air to be sucked into the suction tube 1 is increased and the negative pressure introduced into the depression chamber 6 increases, the connecting member 23 is shifted toward the fuel section of regulator 15 and the second diaphragm 17 is displaced in the direction to compress the spring 19, whereby both the fuel injection rate through the fuel injection port 21 into the suction tube 1 and the fuel flow rate from the fuel chamber 16 through the orifice 22 into the fuel injection chamber 20 are enhanced. Accordingly, the fuel injection system injects the fuel accurately in accordance with the air flow rate in the suction tube 1.

Further, the fuel injection system permits adjusting airfuel ratio of the mixture with the adjusting screw 13. Speaking concretely, when the adjusting screw is preliminarily turned so as to strengthen the resilience of the spring 12, the displacement of the first diaphragm 9 is prolonged for the same increase of the negative pressure in the depression chamber 6 and the needle valve 24 of the connecting member 23 is made apart from the fuel injection port 21 for a longer distance to enhance the fuel injection rate, whereby the mixture having a higher fuel-air ratio is obtained for the same negative pressure. When the adjusting screw 13 is preliminarily turned inversely to weaken the resilience of the spring 12, the mixture having a lower fuel air ratio is obtained for the same negative pressure.

As is understood from the foregoing description, the Embodiment 1 of the present invention wherein the fuel injection port is formed directly in the fuel section of regulator has high fuel control accuracy and responsibility, is relatively simple in the structure of the fuel injection system as a whole and requires a low manufacturing cost.

Figure 2:
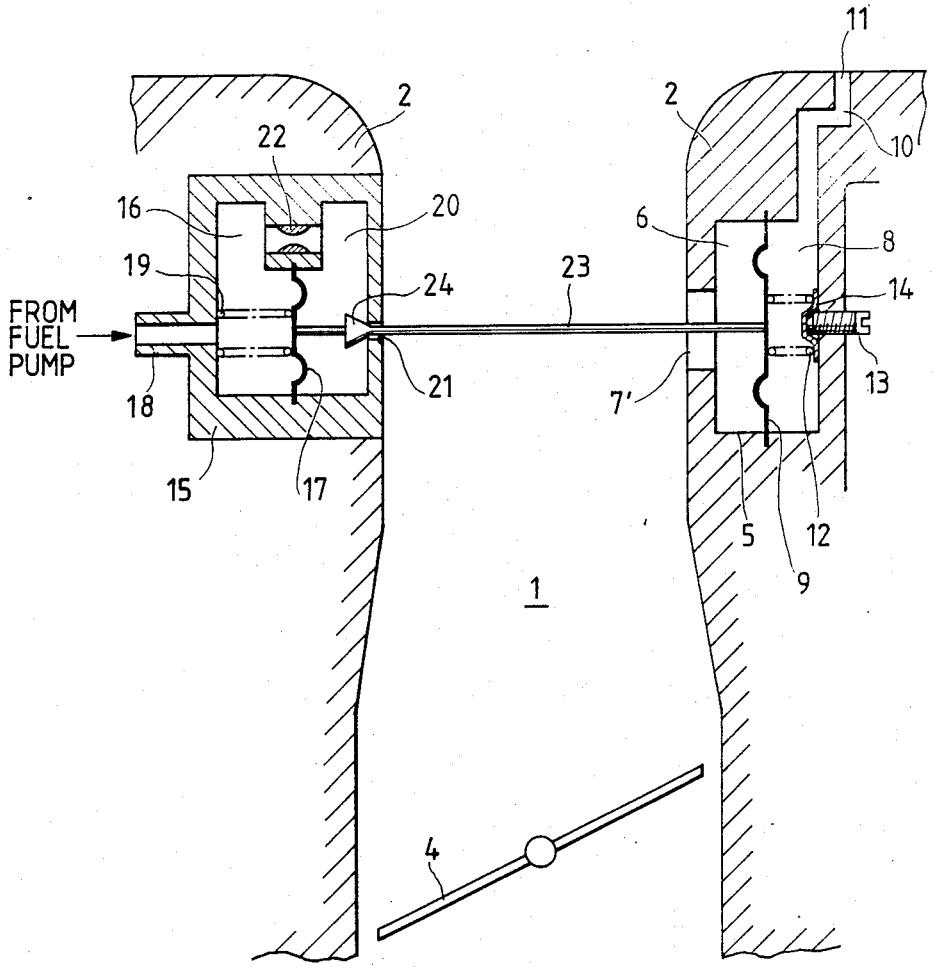
FIG. 2 is a schematic sectional view illustrating Embodiment 2 of the present invention.

Now, the Embodiment 2 of the present invention will be described below with reference to FIG. 2. In this embodiment, arranged in the venturi 2 in the suction tube 1 is a fuel injection system consisting of the air section of regulator and the fuel section of regulator according to the present invention. The reference numeral 7' represents an opening which is formed in the side wall of the depression chamber 6 facing the suction tube 1 and has a diameter several times as large as that of the opening 7 in the Embodiment 1 so as to permit introducing negative pressure produced in the venturi 2 momentarily into the depression chamber 6.

Accordingly, the Embodiment 2 has responsibility of variation of fuel injection rate relative to variation of flow rate of air to be sucked, far higher than that in the Embodiment 1 and is advantageous in the structure thereof since the Embodiment 2 requires no sealing for the opening of the depression chamber with the connecting member unlike the Embodiment 1.

Further, since it is possible to arrange the fuel injection system according to the present invention for each suction manifold corresponding to each cylinder, the fuel injection system according to the present invention makes it possible to meter fuel to be injected for each cylinder and remarkably enhance mixture distribution performance in the multi-point injection type carburetors.

What is claimed is:

1. A fuel injection system for injection carburetors comprising:

an air section consisting of a depression chamber communicating with a venturi arranged in a suction tube and an air chamber communicating with the atmosphere, said chambers being separated from each other by a first diaphragm;

a fuel section consisting of a fuel chamber communicable with a fuel supply source and a fuel injection chamber having an opening communicable with said suction tube, said fuel section chambers being separated from each other by a second diaphragm and communicating with each other through an orifice;

a connecting member connected between said first diaphragm and said second diaphragm provided with an injection valve cooperable with said fuel chamber opening for injecting fuel into said suction tube;

first means for biasing said connecting member so as to displace said injection valve into an open position relative to said fuel chamber opening; and second means for biasing said connecting member so as to displace said injection valve into a closed position relative to said fuel chamber opening and having a biasing force greater than that of said first biasing means;

wherein said air section and said fuel section are disposed in opposed relation relative to each other in the venturi region of the suction tube, and said depression chamber communicates directly with the atmosphere through an opening formed in said venturi.

2. A fuel injection system for injection carburetors comprising:

an air section consisting of a depression chamber communicating with a venturi arranged in a suction tube and an air chamber communicating with the atmosphere, said chambers being separated from each other by a first diaphragm;

a fuel section consisting of a fuel chamber communicable with a fuel supply source and a fuel injection chamber having an opening communicable with said suction tube, said fuel section chambers being separated from each other by a second diaphragm and communicating with each other through an orifice;

a connecting member connected between said first diaphragm and said second diaphragm provided with an injection valve cooperable with said fuel chamber opening for injecting fuel into said suction tube;

first means for biasing said connecting member so as to displace said injection valve into an open position relative to said fuel chamber opening; and second means for biasing said connecting member so as to displace said injection valve into a closed position relative to said fuel chamber opening and having a biasing force greater than that of said first biasing means;

wherein said air section and said fuel section are disposed in opposed relation relative to each other in the wall of said suction tube at a location downstream from said venture, said wall having an opening communicable with said fuel chamber opening, said connecting member cooperating with said suction tube opening and said fuel chamber opening.

3. A fuel injection system for injection carburetors according to claim 1 or 2 further comprising an adjusting screw provided in the side wall of said air section for adjusting said biasing force of said first biasing means.

4. A fuel injection system for injection carburetors according to any one of claims 1 or 2 wherein said fuel injection valve comprises a needle valve cooperable with said fuel chamber opening.

5. A fuel injection system for injection carburetors according to any one of claims 1 or 2 wherein said first biasing means comprises a coil spring interposed between said first diaphragm and the side wall of said air chamber, and said second biasing means comprises a coil spring interposed between said second diaphragm and the side wall of said fuel chamber.

6. A fuel injection system for injection carburetors according to claim 3 wherein said fuel injection valve comprises a needle valve cooperable with said fuel chamber opening, said first biasing means comprising a coil spring interposed between said first diaphragm and the side wall of said air chamber, and said second biasing means comprising a coil spring interposed between said second diaphragm and the side wall of said fuel chamber.

* * * * *